US006955524B2

(12) United States Patent
Stengel

(10) Patent No.: US 6,955,524 B2
(45) Date of Patent: Oct. 18, 2005

(54) NECKLACE FAN

(75) Inventor: Ed Stengel, Kemble (CA)

(73) Assignee: Vectacor (a division of Bonis & Co.), Owen Sound (CA)

( * ) Notice: Subject to any disclaimer, the term of this patent is extended or adjusted under 35 U.S.C. 154(b) by 29 days.

(21) Appl. No.: 10/707,042

(22) Filed: Nov. 17, 2003

(65) Prior Publication Data

US 2005/0106018 A1 May 19, 2005

(51) Int. Cl.[7] ..... B63H 1/00
(52) U.S. Cl. ..... 416/63; 416/205; 416/244 R; 415/129
(58) Field of Search ..... 416/63, 244 R, 416/205; 415/129; 417/234

(56) References Cited

U.S. PATENT DOCUMENTS

| | | | | |
|---|---|---|---|---|
| 3,096,702 | A * | 7/1963 | Malone et al. | 454/370 |
| 4,799,858 | A * | 1/1989 | Shin-Chin | 416/246 |
| 5,046,329 | A * | 9/1991 | Travis, III | 62/259.3 |
| 5,304,035 | A | 4/1994 | Carter | |
| 5,338,495 | A | 8/1994 | Steiner et al. | |
| 5,620,633 | A | 4/1997 | Junkel et al. | |
| 5,667,731 | A | 9/1997 | Junkel et al. | |
| 5,715,999 | A | 2/1998 | Hsu | |
| 5,752,662 | A | 5/1998 | Hsu | |
| 5,843,344 | A | 12/1998 | Junkel et al. | |
| 5,965,067 | A | 10/1999 | Junkel et al. | |
| D428,172 | S * | 7/2000 | Yuen | D26/38 |
| 6,135,174 | A | 10/2000 | Neville | |
| 6,179,564 | B1 | 1/2001 | Park | |
| D451,184 | S * | 11/2001 | Yuen | D23/377 |
| 6,378,845 | B1 | 4/2002 | Hsu | |
| 6,398,132 | B1 | 6/2002 | Junkel et al. | |
| 6,409,475 | B1 * | 6/2002 | Ho | 416/246 |
| D464,420 | S * | 10/2002 | Tolar | D23/382 |
| 2004/0197199 | A1 * | 10/2004 | Cheng | 417/234 |

OTHER PUBLICATIONS

"Portable Necklace Fan", http://www.nithome.co.kr/main/pfmain.html, pp. 1-2.
"Water Misting Fans", http://www.circulair.com/missing.html, pp. 1-2.

* cited by examiner

*Primary Examiner*—Edward K. Look
*Assistant Examiner*—Igor Kershteyn
(74) *Attorney, Agent, or Firm*—Marks & Clerk; Richard J. Mitchell

(57) ABSTRACT

A personal fan has a stable mounting base with a bottom surface adapted to lie against the chest of a wearer and a top surface. The stable mounting base is in the form of a weighted shallow robust body having a length and breadth substantially greater than its thicknes. A tiltable shroudless fan unit is mounted on the top surface. A control for the fan is located on the body. A cord is attachable to the body to permit the body to be suspended around the neck of the wearer such that the bottom surface lies snugly against the wearer's chest and the shroudless fan unit can be oriented to direct airflow onto the user's face and the control is accessible to the user.

10 Claims, 1 Drawing Sheet

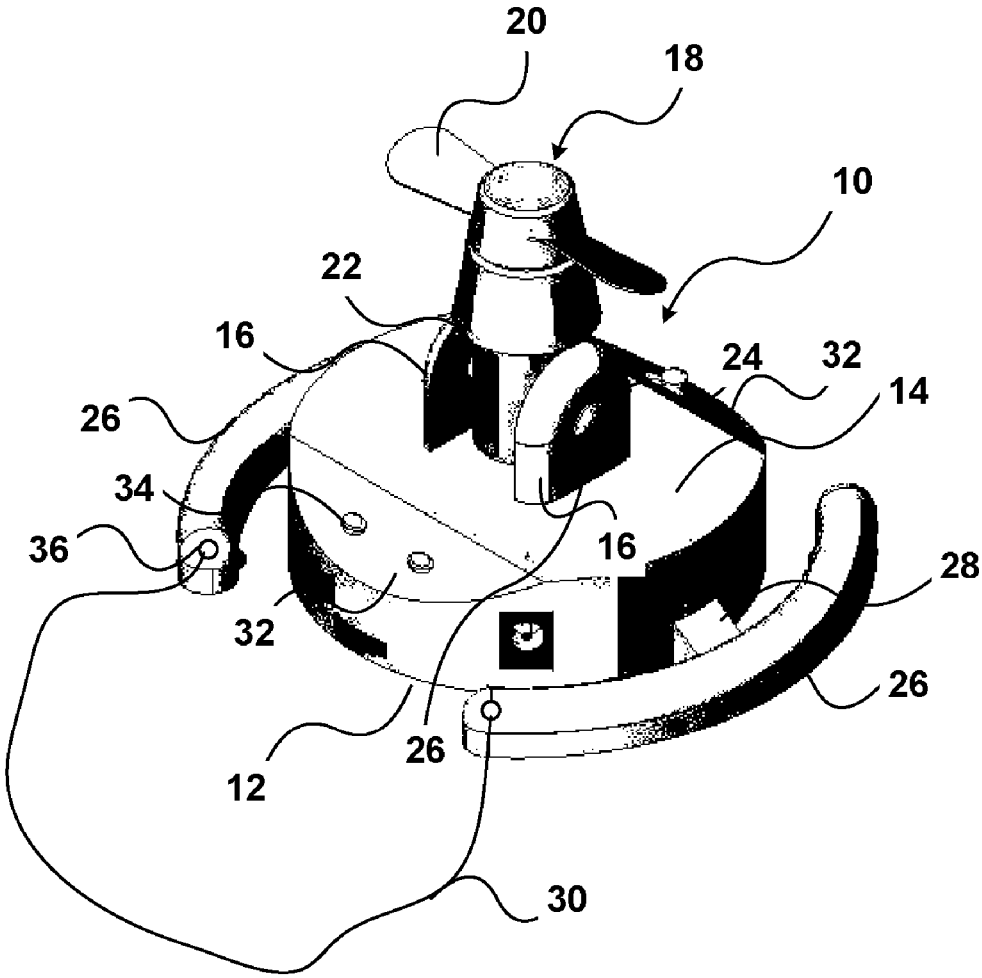
20
18
10
22
16
24
32
14
26
34
36
16
28
32
26
26
12
30

NECKLACE FAN

BACKGROUND OF INVENTION

This invention relates to the field of portable fans, and in particular to a personal fan suitable for hanging around the neck of the user as the user moves about.

There are many situations where it is desirable for a person to be able to carry a portable fan for personal cooling as they move about. For example, in fair grounds, theme parks and the like, which are generally located in warm climates, a person strolling outside can find it unpleasantly hot, especially if the sun is beating down on gravel or hot tarmac.

U.S. Pat. No. 5,304,035 describes a personal fan intended to be suspended around the neck of the user. This device includes a cord that is attached to the housing or the shroud. The device is free of any support structure apart from the housing and shroud.

The problem with such an arrangement is that for the fan to operate effectively it is important that the airflow be accurately directed at the user''s face. The fan described in this patent cannot be mounted in a stable position against the user, and the airflow cannot therefore be precisely directed. As the wearer moves about, the airflow is directed all over the place as the fan unit moves while dangling around the wearer''s neck because there is no stable support for the fan. Also, the shroud interrupts the airflow and thus reduces efficiency, which is important in the case of battery-powered devices.

SUMMARY OF INVENTION

According to the present invention there is provided a personal fan comprising a personal fan comprising a stable mounting base having a bottom surface adapted to lie against the chest of a wearer and a top surface, said stable mounting base being in the form of a weighted shallow robust body having a length and breadth substantially greater than its thickness; a tiltable shroudless fan mounted on said top surface; a control for said fan located on said body; a cord attachable to said body to permit said body to be suspended around the neck of the wearer such that said bottom surface lies snugly against the wearer''s chest and said shroudless fan can be oriented to direct airflow onto the user''s face and said control is accessible to the user.

Such a fan has the advantage that it can be stably mounted on the wearer''s chest. As a result the wearer can accurately direct the airflow onto a precise location, normally his or her face.

The avoidance of a shroud or grill means that the airflow is uninterrupted and the fan is therefore much more efficient.

It will be understood the weight can be provided by the mass of the body itself, or else it can have additional weights contained within a hollow enclosure. The additional weights can conveniently be in the form of batteries powering the fan and which also serve as weights to enhance the stability of the fan when lying against the user's chest. The body then serves the dual purpose of providing a housing for the batteries. Typically a door can be provided on the bottom surface to permit the batteries to be replaced. In one exemplary embodiment the weighted body has a weight in the order of 0.4 lbs, although the actual weight is not critical. It should be sufficient to hold the mounting base firmly against the chest so that it does not swing freely as the wearer moves about.

In a preferred embodiment the body is hollow and contains an accessory device, such as a radio receiver. The wearer can thus cool him or herself while at the same time listening to the radio. The controls for the radio and the fan can be conveniently mounted on the base.

The base is typically in the form of a disc, although it can have other shapes. It is generally in the shape of a shallow flattened body.

BRIEF DESCRIPTION OF DRAWINGS

The invention will now be described in more detail, by way of example only, with reference to the accompanying drawings, in which the single FIGURE is a perspective view of a radio fan in accordance with one embodiment of the invention.

DETAILED DESCRIPTION

—5—Referring now to the FIGURE, the radio fan in accordance with the principles of the invention has a mounting base in the form of generally disc-shaped robust shallow body 10 with a bottom surface 12 and an opposed top surface 14. The bottom surface may be flat, or is preferably contoured to match the shape of a human chest. The mounting base is shown in the horizontal orientation, although it will be understood that in use the mounting base normally lies at an angle snug against the user''s chest.

A pair of spaced lugs 16 protrude normally from the top surface 14, and between them is located a tiltable fan unit 18 consisting of rotatable fan blades 20 and a fan body 22. Protruding trunnions 24 extend from the fan body 22 and are frictionally located in bearing bores 26 in the lugs 16.

The fan blades 20 are made of soft rubbery material so that they do not cause injury on impact. Such fan blades are well known in the art. However, the base 10 also serves to keep the rotating fan blades clear of the user''s body.

The fan unit 18 can thus be tilted between a vertical position as shown and an angled position in which the axis of the fan lies at an angle to the top surface of the shallow body 10. The friction fit ensures that the fan unit 18 retains its orientation after tilting about the trunnions 24.

A pair of arcuate supports 26 are mounted on opposite sides of the body 10 and spaced therefrom. The supports are mounted on arms 28, which space them from the body 10. A cord 30 passes through holes 36 in the opposed ends of the supports 16.

The top surface 14 of the body 10 has beveled edges 32 on opposite sides of the body 10. Controls 34 are located on the beveled edges 34.

The controls 34 can control the operation of the fan unit 18. For example, they can include an on-off switch and if desired a speed control.

Power for the fan unit can be supplied by a battery, which is normally located inside the hollow body 20. The motor for the fan is typically mounted in the fan body 22, and the unit 18 can be connected to the body 10 by a flexible wire (not shown).

In a preferred embodiment, the body 10 also includes a radio receiver, which can be of any suitable type, for example, an fm radio receiver. The controls 34 also control the operation of the radio receiver. The radio received will normally have a separate battery within the hollow body 10. A suitable speaker can be mounted on the body 10, for example on the sidewall. Alternatively, an earphone jack can be provided on the body 10 to permit the user to plug in a standard earphone.

The presence of the batteries in the hollow body 10 serves to weight the fan and thus increase the stability of the body 10 when lying against the wearer''s chest.

The body is typically made of molded plastics material, and weighs approximately 0.4 pounds with the batteries present. The dimensions of the exemplary embodiment are 10 cm Wide×10 cm Deep×10 cm High (with Fan head pointed straight-up) or 7.5 cm High (with Fan head parallel to base).

The personal fan is thus highly stable and allows the wearer to direct the air at the required location, normally his or her face, in a consistent manner as the user moves about.

What is claimed:

1. A personal fan comprising:

a stable mounting base having a bottom surface adapted to lie against the chest of a wearer and a top surface, said stable mounting base being in the form of a weighted shallow robust body having a length and breadth substantially greater than its thickness;

a tiltable shroudless fan unit mounted on said top surface;

a control for said fan located on said body;

a pair of arcuate support members attached to opposite sides of said stable mounting base; and a cord attached to said pair of arcuate support members to permit said body to be suspended around the neck of the wearer such that said bottom surface lies snugly against the wearer's chest and said shroudless fan unit can be oriented to direct airflow onto the wearer's face and said control is accessible to the user.

2. A personal fan as claimed in claim 1, wherein said tiltable fan unit is mounted on a pair of lugs protruding from said top surface.

3. A personal fan unit as claimed in claim 2, wherein said tiltable fan unit is mounted in said lugs by means of trunnions frictionally engaging bearing bores in said lugs.

4. A personal fan as claimed in claim 1, wherein said cord is passed through boles in opposing ends of said arcuate support members.

5. A personal fan as claimed in claim 1, wherein said body is in the form of a shallow disc.

6. A personal fan as claimed in claim 4, wherein said shallow disk has a beveled edge on the top surface thereof, and said control is located on said beveled surface.

7. A personal fan as claimed in claim 1, wherein said body is hollow and contains an accessory device.

8. A personal fan as claimed in claim 7, wherein said accessory device is a radio, and a control for said radio is located on said body.

9. A personal fan as claimed in claim 1, wherein said bottom surface is contoured to match the shape of a human chest.

10. A personal fan as claimed in claim 1, wherein a battery for powering said fan is located within said body.

* * * * *